US007409784B2

(12) United States Patent
Yeh

(10) Patent No.: US 7,409,784 B2
(45) Date of Patent: Aug. 12, 2008

(54) ELECTRICITY-PRODUCING SHOE

(76) Inventor: Ming-Hsiang Yeh, 14F, No. 375, Nan-Gang District, Fu De Street, Taipei City (TW)

( * ) Notice: Subject to any disclaimer, the term of this patent is extended or adjusted under 35 U.S.C. 154(b) by 351 days.

(21) Appl. No.: 11/256,072

(22) Filed: Oct. 24, 2005

(65) Prior Publication Data

US 2007/0089321 A1 Apr. 26, 2007

(51) Int. Cl.
*A43B 23/00* (2006.01)
*H02K 7/10* (2006.01)

(52) U.S. Cl. ..... 36/136; 36/132; 36/137; 310/75 B

(58) Field of Classification Search ..... 36/132, 36/136, 2.6, 137; 310/75 B
See application file for complete search history.

(56) References Cited

U.S. PATENT DOCUMENTS 1,506,282 A * 8/1924 Barbieri ..... 310/75 B
4,674,199 A * 6/1987 Lakic ..... 36/2.6
5,495,682 A * 3/1996 Chen ..... 36/2.6
6,255,799 B1 * 7/2001 Le et al. ..... 320/107

* cited by examiner

*Primary Examiner*—Ted Kavanaugh
(74) *Attorney, Agent, or Firm*—Apex Juris, pllc; Tracy M Heims

(57) ABSTRACT

An electricity-producing shoe comprises a shoe body including an electricity-producing module and an electricity generator mounted therein. The electricity-producing module includes a rack, first and second gears, and a spring buffer that mounts between the first and second gears. The first and second gears are engaged with the rack and an axial gear of the electricity generator, respectively. The electricity generator has an electricity output terminal connected to an electric device of the shoe body. As a result, the rack drives the first gear and the second gear drives the axial gear of the electricity generator by means of normal stepping motion of walking for producing electric power and thereby supplying the electric power for the electric device.

5 Claims, 4 Drawing Sheets

ELECTRICITY-PRODUCING SHOE

FIELD OF THE INVENTION

The present invention relates an electricity-producing shoe that utilizes stepping motion of walking to produce electric power, and more particularly to an electricity-producing shoe applicable to a leather shoe, a gym shoe, a sports shoe, a walking shoe, or the like.

BACKGROUND OF THE INVENTION

The major objective of shoe is to protect the foot during walking and to make the foot comfortable. More recently, the shoe is designedly suitable for various purposes besides having an esthetically desirable appearance. Various shoes that equip with various specific functions are gradually developed. For example, a step-counting shoe can count steps of walking; a light-emitting shoe can show a blinker light; an air cushion shoe can provide the shock-absorbing function; and an anion shoe that deodorizes and sterilizes is even invented.

However, these specific shoes must be provided with power-supplying units in order to implement their specific functions. These conventional power-supplying units mostly are composed of batteries. But, every battery has its own lifetime. When its electric power is exhausted, this battery must be replaced with a new one so as to maintain normal working of electric device.

Moreover, every battery such as dry battery, mercury battery, or lithium battery is harmful to the ecosystem of the earth. Therefore, the environmental groups always appeal to people for reducing usage amounts of batteries. The major drawback of the conventional shoes with specific functions apparently consists in that they cannot work without batteries.

In view of the aforementioned conventional deficiency, the present inventor makes a diligent study to provide the consumer with an electricity-producing shoe capable of producing electric power by use of gravity drop formed naturally during stepping motion of walking in accordance with the motive of the present invention.

SUMMARY OF THE INVENTION

It is a main objective of the present invention to provide an electricity-producing shoe that utilizes stepping motion of walking to produce electric power.

It is another objective of the present invention to disclose an electricity-producing shoe that supplies the produced electric power for an electric device mounted on the shoe or other electric product.

In order to achieve the aforementioned objective, an electricity-producing shoe comprises a shoe body including an electricity-producing module and an electricity generator mounted therein. The electricity-producing module includes a rack, first and second gears, and a spring buffer that mounts between the first and second gears. The first and second gears are engaged with the rack and an axial gear of the electricity generator, respectively. The electricity generator has an electricity output terminal connected to an electric device of the shoe body. As a result, the rack drives the first gear and the second gear drives the axial gear of the electricity generator by means of normal stepping motion of walking for producing electric power and thereby supplying the electric power for the electric device.

The aforementioned aspects and advantages of the present invention will be readily clarified in the description of the preferred embodiments and the enclosed drawings of the present invention.

DETAILED DESCRIPTION OF THE PREFERRED EMBODIMENT

Figure 1:
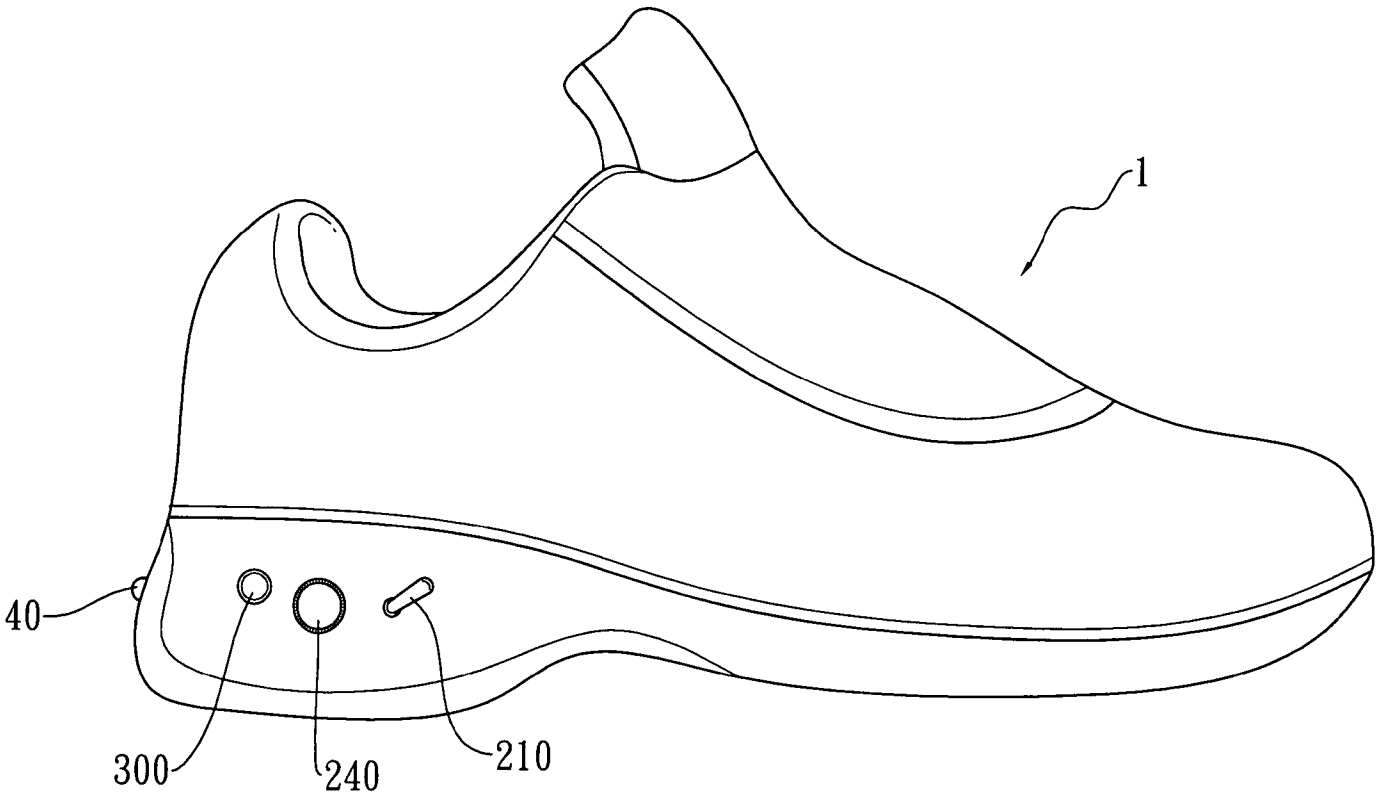
FIG. 1 is a lateral view showing the structure of the present invention.
Figure 2:
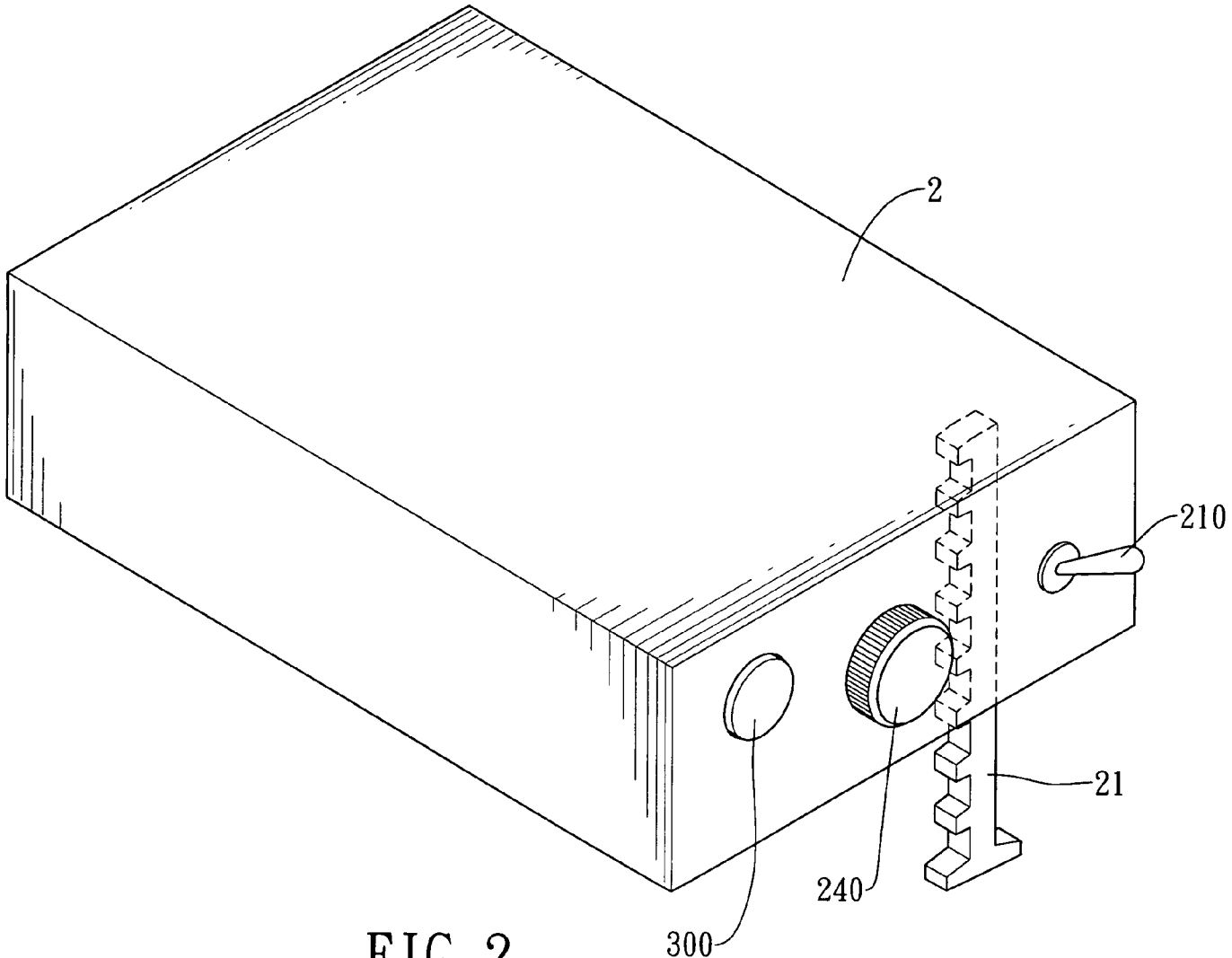
FIG. 2 is a three-dimensional view showing the case of the present invention.
Figure 3:
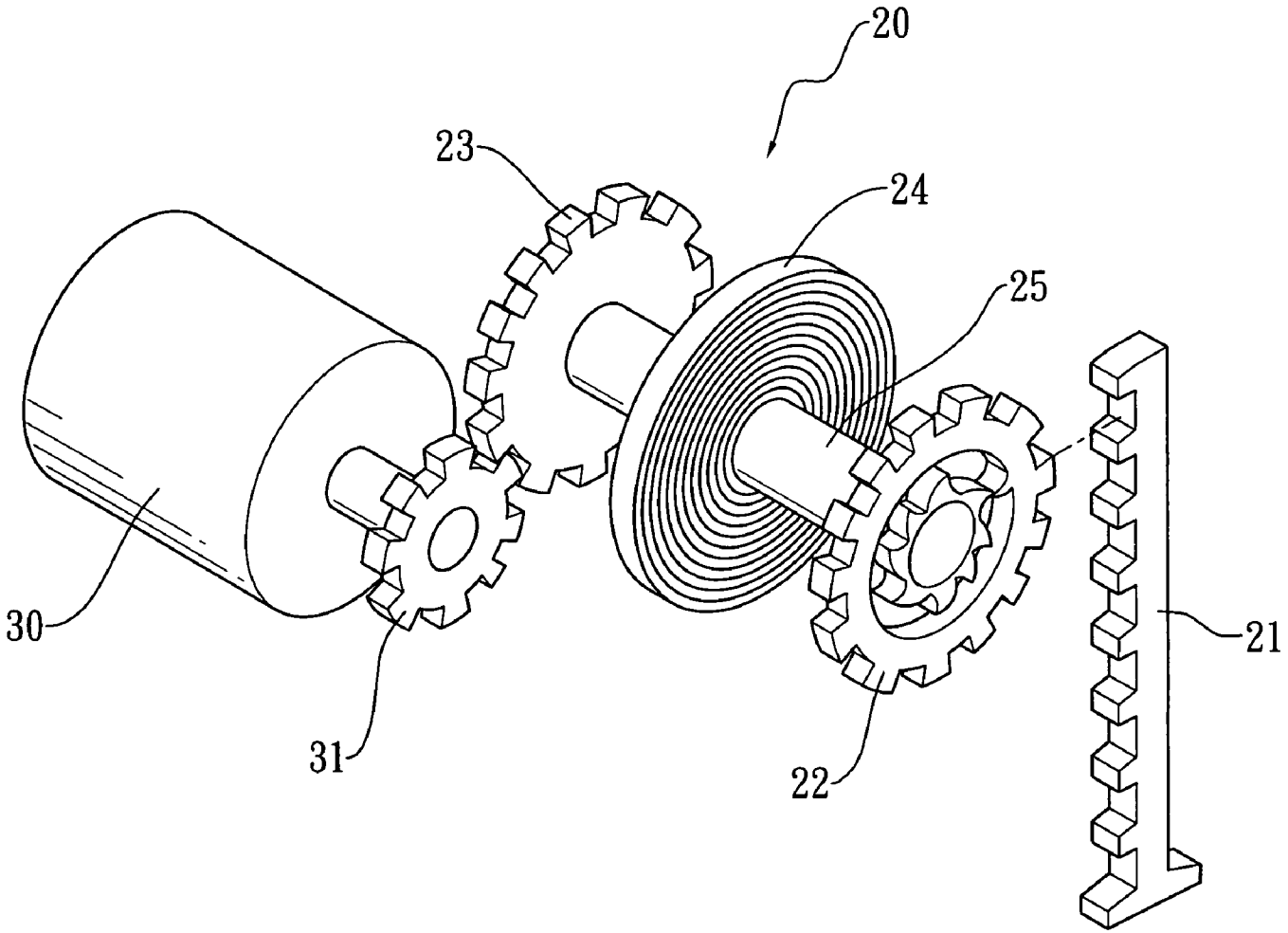
FIG. 3 is a schematic, cross-sectional view showing the interactive engagements among interior components of FIG. 2.

Referring to FIG. 1 through FIG. 3, the present invention comprises a shoe body 1 having a case 2 mounted therein. In addition, an adjusting knob 240, a clutch rod 210 of a clutch, and a control switch 300 are mounted outside the case 2, wherein the shoe body 1 is, for example, a leather shoe, a sports shoe, a walking shoe, etc. In this preferred embodiment, an exemplary walking shoe is illustrated. The case 2 has an electricity-producing module 20 and an electricity generator 30 mounted therein, wherein the electricity-producing module 20 is composed of a rack 21, a one-way gear 22, a spring buffer 24, a gear 23, and a shaft 25. The shaft 24 is mounted to insert through the spring buffer 24. Moreover, the one-way gear 22 is axially coupled to one end of the shaft 25, and the gear 23 is axially coupled to the other end of the shaft 25. In addition, the one-way gear 22 is engaged and moved together with the rack 21.

The electricity generator 30 has a rotation shaft to which an axial gear 31 is mounted. The axial gear 31 is engaged with the gear 23 of the electricity-producing module 20 (described above). An electric device that keeps warm, exsiccates, deodorizes, and fans, for example, is mounted on the shoe body 1, and connected to an electricity output terminal of the electricity generator 30. In this preferred embodiment, an exemplary light-emitting diode 40 is utilized. Furthermore, the adjusting knob 240 is designed for adjusting the elastic strength of the spring buffer 24 to match the body weight of the user. The clutch rod 210 of the clutch is designed for controlling engagement and disengagement between the rack 21 and the one-way gear 22. In addition, the control switch 300 is designed to switch on or switch off the electricity generator 30.

The bottom of the rack 21 is coupled to a bottom portion of the heel of the shoe body 1. The axial gear 31 of the electricity generator 30 that mounts on one end of the shaft 25 is engaged with the gear 23 of the electricity-producing module 20. The one-way gear 22 that mounts on the other end of the shaft 25 is engaged with the rack 21. The electricity output terminal of the electricity generator 30 is connected to the light emitting diode 40. As a result, when the shoe body 1 is pushed downward against the ground during stepping motion of walking, the rack 21 is shifted upward by counterforce so as to simultaneously rotate the one-way gear 22 that engages with the rack 21. The one-way gear 22 can drive the shaft 25 in a single direction. For example, it is assumed that the one-way gear 22 can drive the shaft 25 when the rack 21 shifts upward. On the contrary, the one-way gear 22 is idle when the rack 21 shifts downward. Accordingly, the rotation of the shaft 25 enables the synchronous rotation of the gear 23 that mounts opposite to the one-way gear 22 so as to further drive the axial gear 31 that engages with the electricity generator 30, whereby the electricity generator 30 produces electric power and supplies the light emitting diode 40 with the produced electric power.

Figure 4:
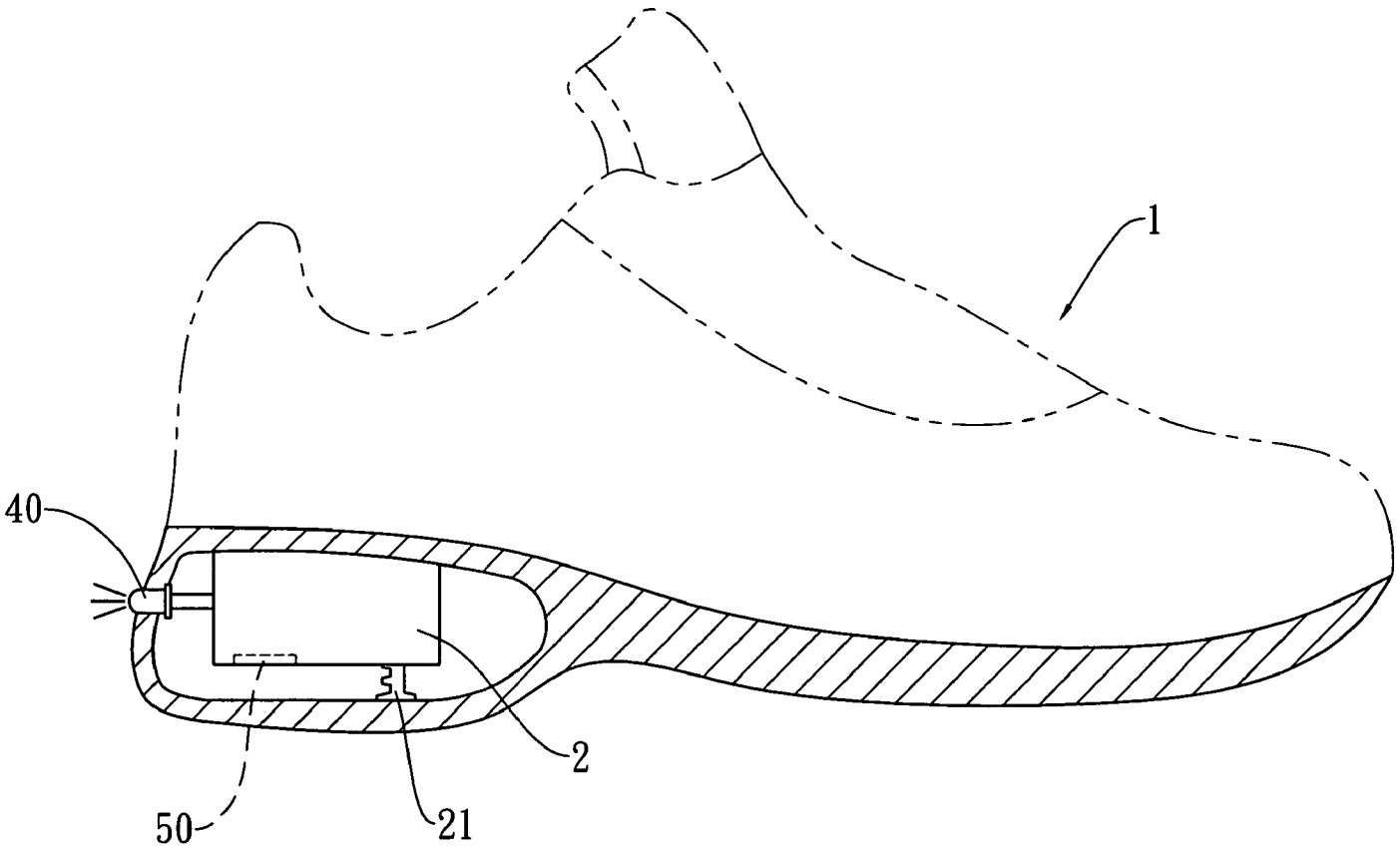
FIG. 4 is a schematic view showing another application of the present invention.

Referring further to FIG. 4, the electricity output terminal of the electricity generator 30 can be connected to an electricity storage unit such as a battery 50 for storing the electric power that is produced as described above. An optional step-up/step-down device or an optional charger may be further utilized. Furthermore, the spring buffer 24 that mounts between the one-way gear 22 and the gear 23 absorbs and buffers large shocks when the user is running or jumping. Besides, the spring buffer 24 also can accumulate kinetic energy generated by small shocks such that the electricity generator 30 can obtain smooth kinetic energy.

Alternatively, another gear on which a runout device is mounted can be utilized in place of the above-mentioned one-way gear 22 of the electricity-producing module 20. In addition, two racks 21 are mounted on both sides of this gear, respectively, such that this gear is controlled by the runout device and biasedly engages with one of these two racks 21, whereby the electricity generator 30 becomes a two-way electricity generator.

Moreover, the electricity generator 30 can be a reciprocating generator instead of the traditional rotor-type generator, wherein a spring is sleeved directly on a reciprocating spindle of the reciprocating generator and a front end of the reciprocating spindle is connected to and moved together with a bottom portion of the heel of the shoe body 1. Besides, the body of the reciprocating generator is fixedly secured to a top portion of the heel of the shoe body 1. As a result, when the shoe body 1 is in stepping motion, the reciprocating spindle is shrunk into the body of the reciprocating generator. Thereafter, the strain of the reciprocating spindle is released by the spring that sleeves thereon. Accordingly, the electric power can be produced by means of reciprocating movement. Moreover, several above-mentioned structures can be mounted inside the shoe body 1 so as to produce a large amount of electricity.

According to the foregoing description, it is apparent that the apparatus of the present invention has several advantages as follows:

1. During normal stepping motion of the walk, the electricity-producing module can produce electric power insensibly.

2. The electricity-producing shoe with simplified components protects user's foot from shock, achieves the environmental protection, and supplies the electric power for the user during his burdenless, resistless walk.

3. The electricity-producing shoe of the present invention is a very practical structure for long-distance walkers such as climbers or troops and enables them to produce and store electricity during their walks, whereby there is no need to carry too many backup batteries and change the predetermined trip.

In summary, the electricity-producing shoe of the present invention satisfies patentability. Accordingly, it is submitted for a patent.

While the preferred embodiment of the invention has been set forth for the purpose of disclosure, modifications of the disclosed embodiment of the invention as well as other embodiments thereof may occur to those skilled in the art. Accordingly, the appended claims are intended to cover all embodiments, which do not depart from the spirit and scope of the invention.

What the invention claimed is:

1. An electricity-producing shoe comprising:

a shoe body; and a case mounted inside the shoe body, the case including an adjusting knob mounted outside the case for adjusting elastic strength of the spring buffer and an electricity-producing module and an electricity generator mounted inside the case, the electricity-producing module including a first rack, first and second gears, and a spring buffer mounted between the first and second gears, wherein the first and second gears are engaged with the first rack and an axial gear of the electricity generator, respectively, and an electricity output terminal of the electricity generator is connected to an electric device of the shoe body such that the first rack drives the first gear and the second gear drives the axial gear of the electricity generator by means of normal stepping motion of walking for producing electricity and thereby supplying the electricity for the electric device.

2. The electricity-producing shoe of claim 1, wherein the first gear is a one-way gear such that the electricity generator is a one-way electricity generator.

3. The electricity-producing shoe of claim 1, further comprising an electricity storage unit connected to the electricity output terminal of the electricity generator.

4. The electricity-producing shoe of claim 1, further comprising a clutch rod of a clutch mounted outside the case for controlling engagement and disengagement between the first rack and the first gear.

5. The electricity-producing shoe of claim 1, further comprising a control switch mounted outside the case for switching on or switching off the electricity generator.

* * * * *